US010549894B2

(12) United States Patent
Enterline et al.

(10) Patent No.: US 10,549,894 B2
(45) Date of Patent: Feb. 4, 2020

(54) CONTAINER CLOSURE

(71) Applicant: Maugus Manufacturing, Inc., Lancaster, PA (US)

(72) Inventors: Jason M. Enterline, Columbia, PA (US); Scott Cartwright, Stevens, PA (US)

(73) Assignee: Maugus Manufacturing, Inc., Lancaster, PA (US)

( * ) Notice: Subject to any disclaimer, the term of this patent is extended or adjusted under 35 U.S.C. 154(b) by 369 days.

(21) Appl. No.: 15/402,714

(22) Filed: Jan. 10, 2017

(65) Prior Publication Data

US 2018/0194526 A1 Jul. 12, 2018

(51) Int. Cl.
*B65D 51/32* (2006.01)

(52) U.S. Cl.
CPC ..... *B65D 51/32* (2013.01)

(58) Field of Classification Search
CPC ..... B65D 51/32
USPC ..... 15/209.1
See application file for complete search history.

(56) References Cited

U.S. PATENT DOCUMENTS 1,609,588 A * 12/1926 Vickery ..... B65D 51/32 401/118
1,615,603 A * 1/1927 Vickery ..... B65D 51/32 401/130
1,645,159 A * 10/1927 Russell ..... A47L 23/05 401/122
1,756,397 A * 4/1930 Spohn, Jr. ..... B65D 23/00 215/12.1
1,913,526 A * 6/1933 Cleef ..... B65D 51/32 401/130
2,001,086 A * 5/1935 Villanyi ..... B65D 51/32 401/130
2,160,517 A 5/1939 Rabinowitz et al.
2,182,046 A * 12/1939 Crabbe ..... B43M 11/06 401/130
2,975,452 A * 3/1961 Doull ..... A47L 23/04 15/209.1
7,854,561 B1 * 12/2010 Ammons ..... A45D 34/046 206/1.7
7,874,754 B1 * 1/2011 Ammons ..... B44D 3/126 206/1.7

* cited by examiner

*Primary Examiner* — Weilun Lo
(74) *Attorney, Agent, or Firm* — Barley Snyder

(57) ABSTRACT

A container closure is provided and includes a cap, a stem, and an applicator. The cap is formed to secure to a container. The stem includes plurality of bends to form a body, a base positioned at one end of the body, and a head positioned at another end of the body that is opposite the base, the stem secured to an inner surface of the cap. The applicator includes a plurality of strands that are formed into a rope by single fibers. The plurality of strands provide a core that is secured by the head.

15 Claims, 16 Drawing Sheets

CONTAINER CLOSURE

FIELD OF THE INVENTION

The invention relates to a container closure and, more particularly, to a container closure having an attached applicator for applying a substance within a container.

BACKGROUND

Industry has been manufacturing container closures for many years that include an applicator for applying contents within a container, especially when the container holds a solvent or other liquid. For instance, polyester dauber brushes are often combined with closures in order for the user to apply polyvinyl chloride cement for a particular purpose. However, newer substances are continually being developed that having viscosities and material properties that differ from older products and, as a result, a user has issues applying these new substances using the known applicators that are currently available. Often the known applicators either fail to retain or properly apply newer substances for their intended purpose. Therefore, there is a need to develop a container closure with applicator that can properly apply newer substances for their intended purpose.

SUMMARY

Therefore, the invention relates to a container closure having a cap, a stem, and an applicator. The cap is formed to secure to a container. The stem includes plurality of bends to form a body, a base positioned at one end of the body, and a head positioned at another end of the body that is opposite the base, the stem secured to an inner surface of the cap. The applicator includes a plurality of strands that are formed into a rope by single fibers. The plurality of strands provide a core that is secured by the head.

BRIEF DESCRIPTION OF THE DRAWINGS

The invention will be explained in greater detail in the following with reference to embodiments, referring to the appended drawings, in which.

DETAILED DESCRIPTION OF THE EMBODIMENT(S)

Figure 1:
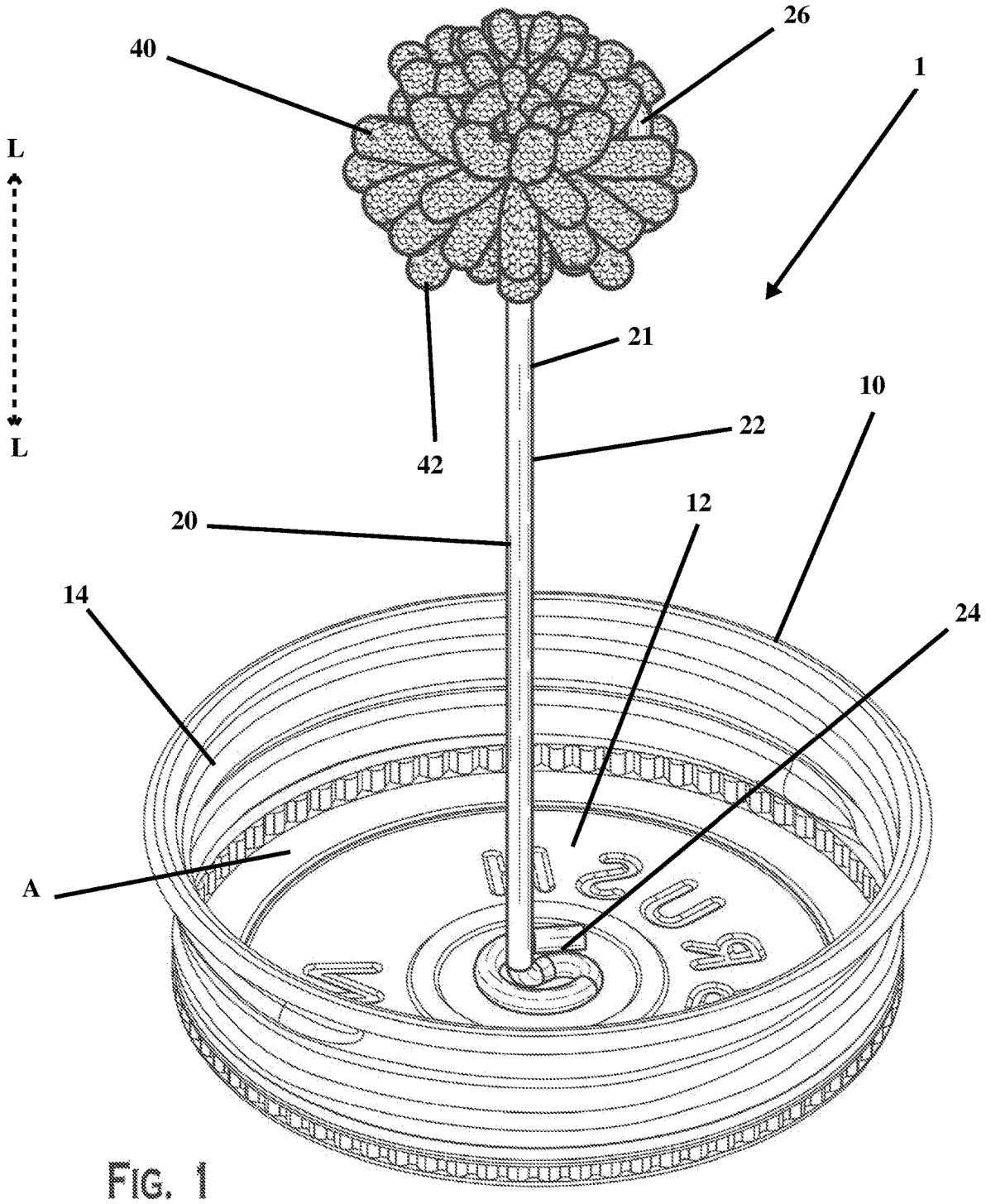
FIG. 1 is a perspective view of a container closure according to the invention.

Now with reference to the FIGS. 1-26, a container closure 1 according to the invention will be described.

It will be obvious to those skilled in the art to which the invention appertains, that the same may be incorporated in several different constructions. The accompanying drawings therefore are provided merely as showing the exemplary embodiments of the invention.

As shown in FIGS. 1-9, a container closure 1 according to the invention is shown. The container closure 1 generally includes the following major components: a cap 10, a stem 20, and an applicator 40.

For the container closure 1 according to the invention, the cap 10 may be any suitable type adapted to close a container. As shown, the cap 10 is made from sheet of material and, more particularly, being metal. However, one skilled in the art should appreciate that other materials may be used, including plastics and composites, which may be used to suitable control a seal with the container and reaction with a substance in the container. To assure rapid inexpensive manufacture of the cap 10, a relatively soft metal is generally used for construction of the cap 10.

A shown in FIGS. 1-4, the cap 10 includes a circular top wall 12 and a depending annular side wall 14. While the exemplary embodiment shows the annular side wall 14 is threaded, one skilled in the art should appreciate other known fastening mechanisms may be used or included with the cap 10 design, such as clasps, clips, and detent systems.

A liner A is also provided along the circular top wall 12 in the exemplary embodiment shown. The liner A is disk shaped and, more particularly, a washer shaped member having a stem receiving passageway extending there through. As shown, the liner A is made of suitable material that can provide a seal when the cap 10 is secured to a container. Furthermore, it would be advantageous that the liner A not be reactive with the substance held within a container that seals with the cap 10. The liner A is removably positioned along an inner surface of the top wall 12 and along the inner surface of the annular side wall 14. It is possible that the liner A be permanently secured to the top wall 12 and/or the side wall 14.

FIGS. 10-16 are provided to more properly illustrated the stem 20 of the container closure 1. As shown, the stem 20 is an elongated member 21, such as a wire, having a plurality of bends to form a body 22, a base 24 positioned at one end of the body 22, and a head 26 positioned at another end of the body 22 that is opposite the base 24.

As shown, the stem 20 is made from wire of material and, more particularly, being metal. However, one skilled in the art should appreciate that other materials may be used, including plastics and composites, which may be used to provide support and position of the applicator 40 with respect to the cap 10. The stem 20 should be made from a rigid, sturdy material and should not react with a substance in the container. To assure rapid inexpensive manufacture of the stem 20, a relatively soft metal is generally used for construction of the stem 20.

The body 22 is a section of the elongated member 21 that is substantially straight in the embodiment shown. The length of the body 22 is dependent on the height of a container the container closure 1 is sealed thereto. Typically, the body 22 is of a length that allows the applicator 40 to reach a bottom of the container when the cap 10 is secured to the container.

As shown, the base 24 is a section of the stem 20. More particularly, the base 24 is a section of the elongated member 21. In the embodiment shown, the base 24 includes a plurality of bends to form a planar surface that is perpendicular with respect to a longitudinal axis L of the body 22. In an exemplary embodiment of the invention, the base 24 extends from the body by a 90-degree bend. In an exemplary embodiment of the invention, the base 24 includes a plurality of bends in the elongated member 21. As shown, the base 24 is g-shaped from the 90-degree bend. However, one skilled in the art should appreciate that the base 24 could be shaped differently to provide a planar surface that is perpendicular with respect to the longitudinal axis L of the body 22.

Likewise, as shown, the head 26 is also section of the stem 20 and, more particularly, a section of the elongated member 21 shaped to secure the applicator 40. However, the head 26 includes a plurality of bends to form a planar surface that is parallel with respect to a longitudinal axis L of the body 22. In an exemplary embodiment of the invention, the head 26 extends from the body by a 90-degree bend. In an exemplary embodiment of the invention, the head 26 includes a plurality of bends in the elongated member 21. As shown, the head 26 is g-shaped member extending from the 90-degree bend. However, the head includes a lateral applicator receiving gap 28 positioned between ends g-shaped member, as well as a horizontal applicator receiving space 30 extending there through a substantial middle. One skilled in the art should appreciate that the head 26 could be shaped in many different ways as long as the head 26 is capable of holding the applicator 40.

Figure 2:
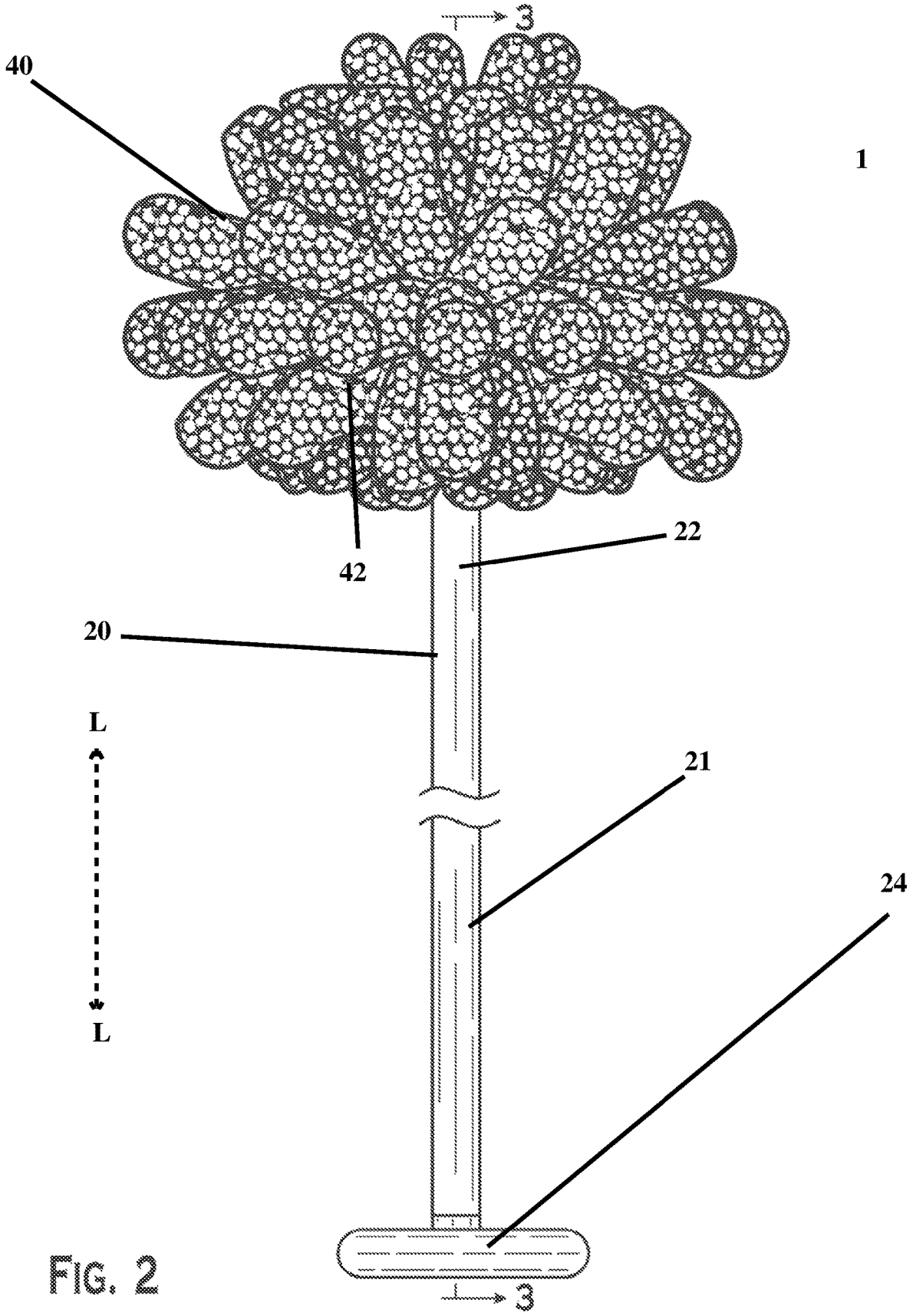
FIG. 2 is a front view of an applicator for the container closure according to the invention.
Figure 3:
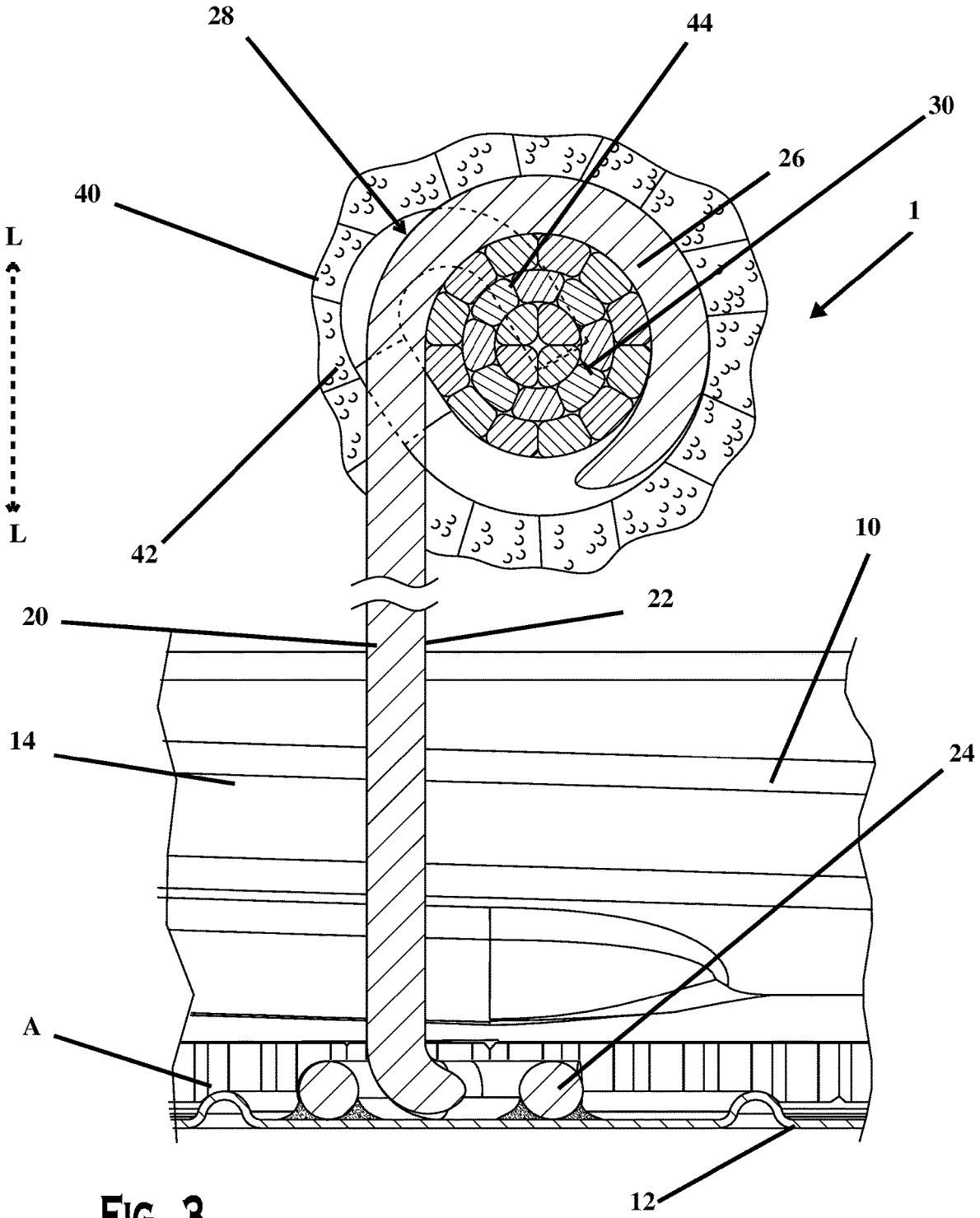
FIG. 3 is a section view of the container closure of FIG. 2, taken along line 3-3.

In the embodiment shown in FIGS. 1-3, the applicator 40 is a collection of textile strands. In particular, the applicator 40 is a 100% polyester composition made into strands 42 prepared in rope form. Each strand 42 is approximately 6 mm in diameter in the embodiment shown. When combined, the strands 42 include a center elastic core 44 and are woven to produce an absorbent "frayed" appearance at the outer areas of the diameter. The applicator 40 includes approximately 8-24 strands 42 in the shown embodiment.

Figure 4:
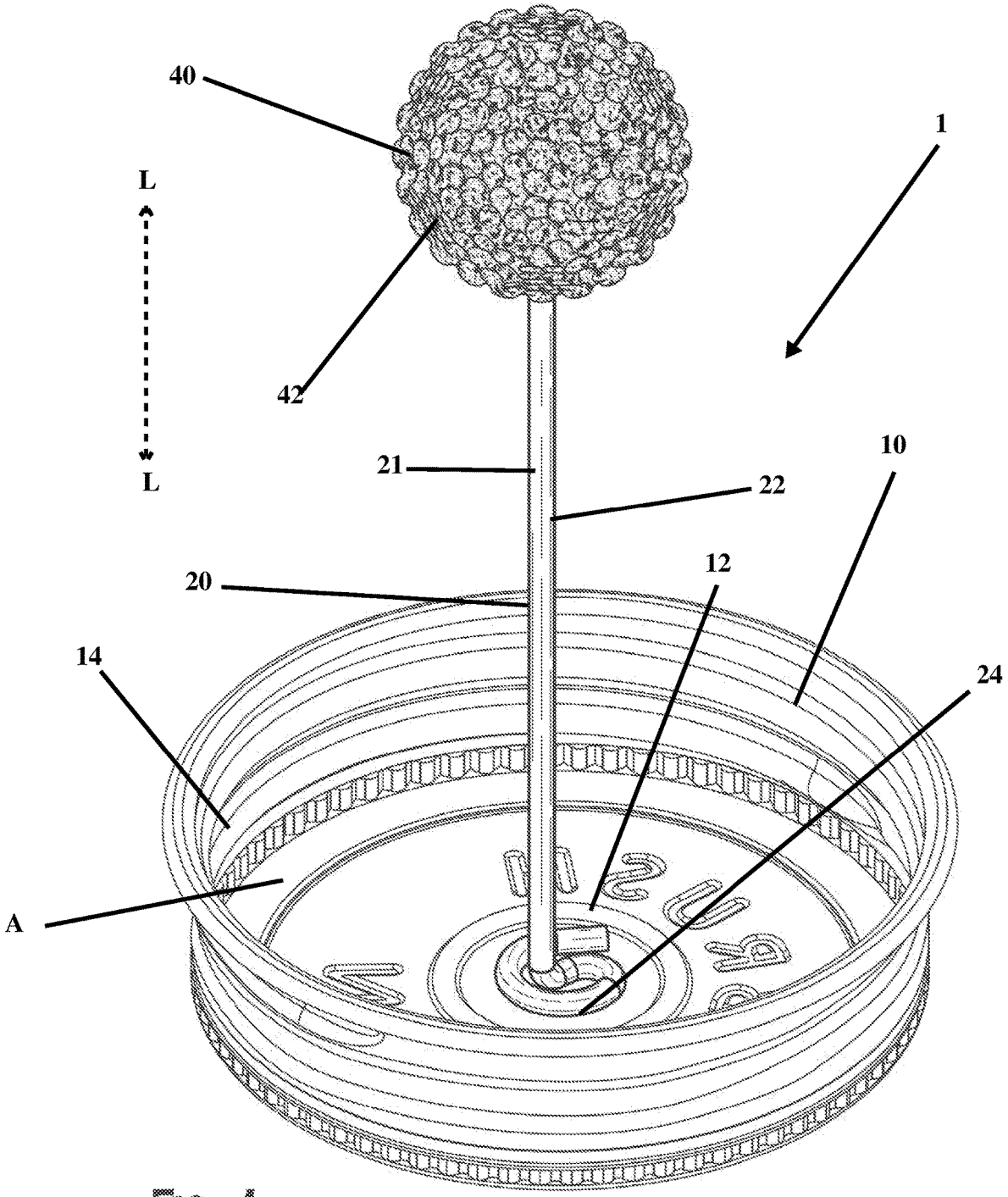
FIG. 4 is a perspective view of another container closure according to the invention.
Figure 5:
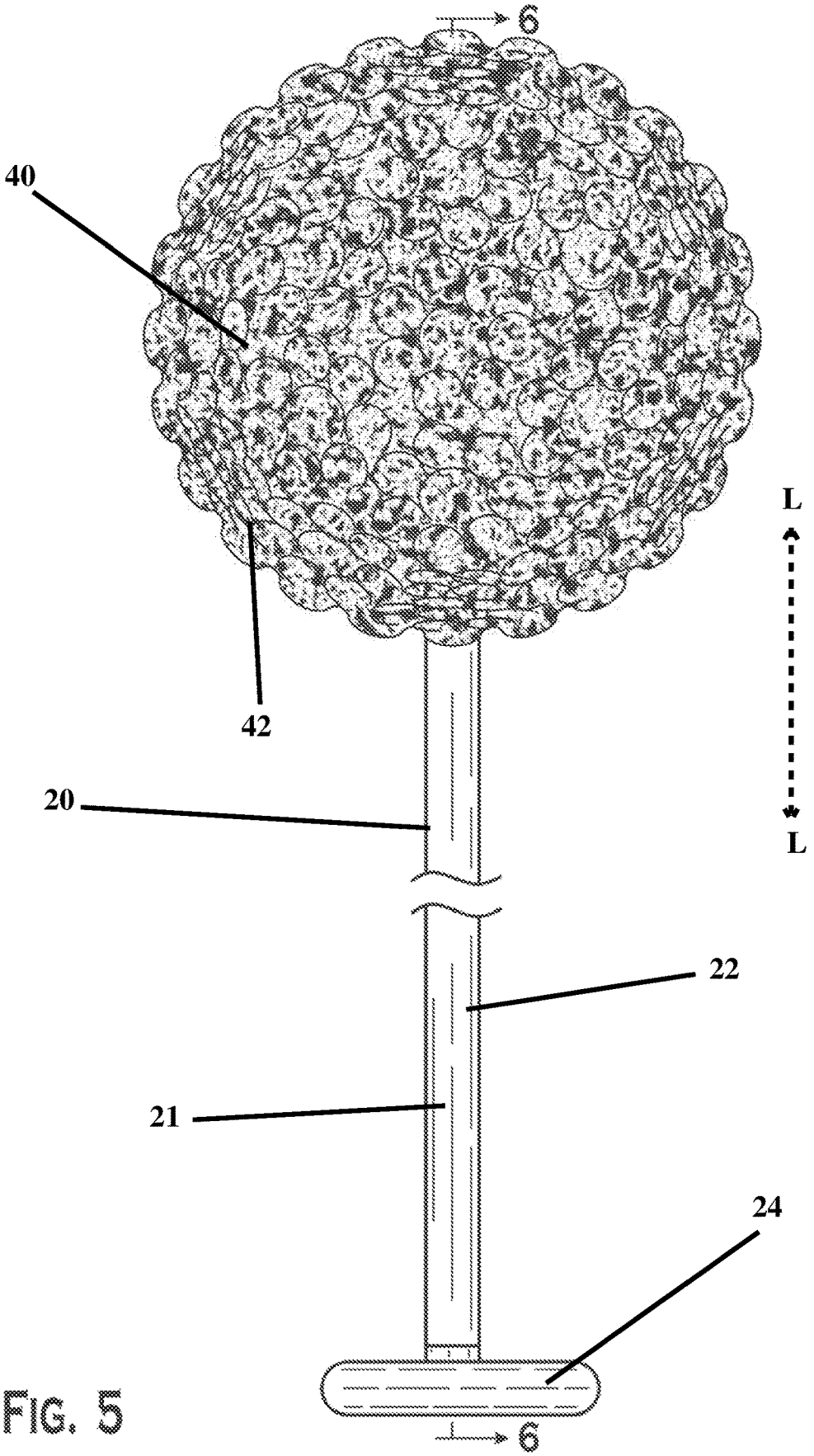
FIG. 5 is a front view of an applicator for the container closure of FIG. 4.
Figure 6:
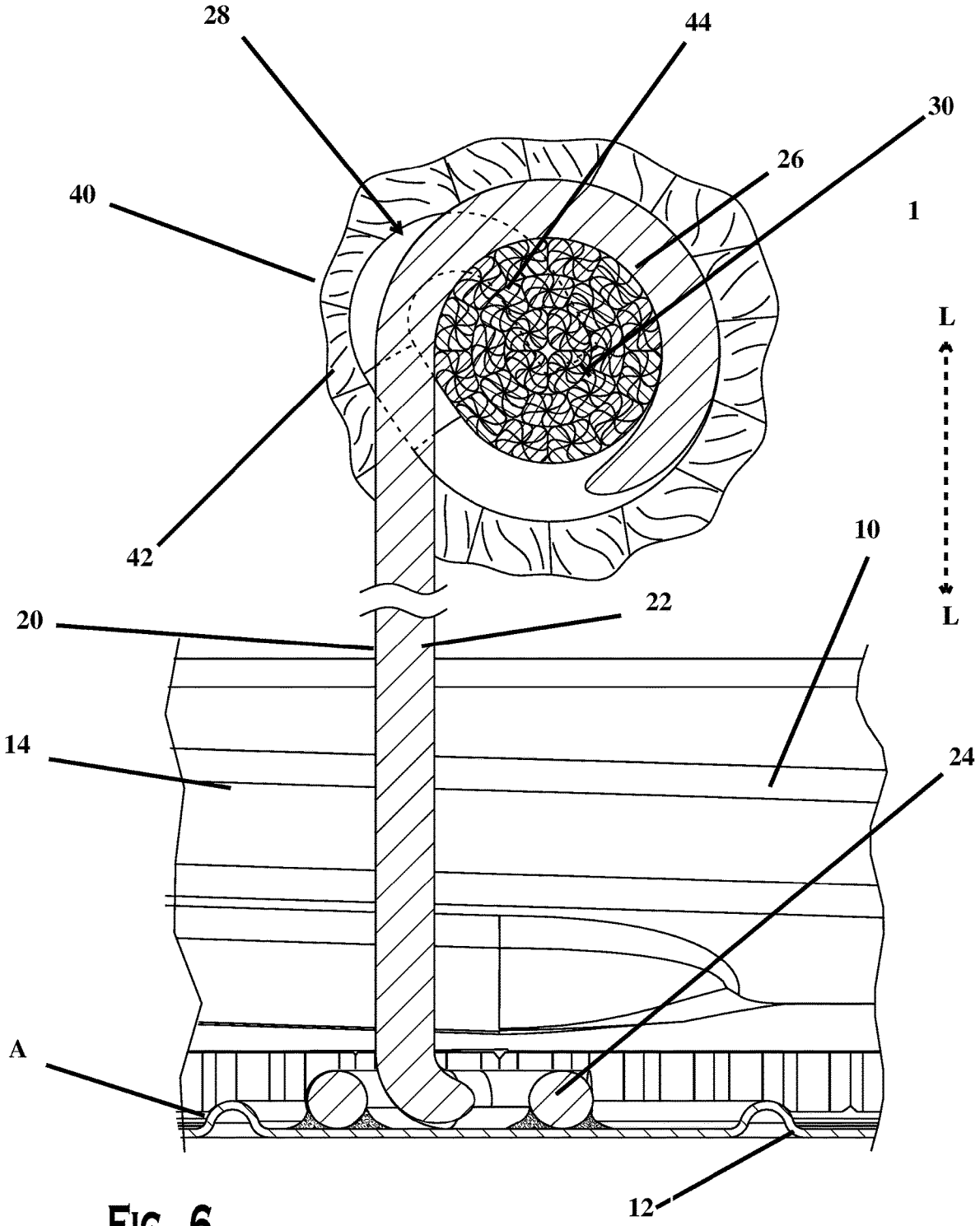
FIG. 6 is a section view of the container closure of FIG. 5, taken along line 6-6.

In the embodiment shown in FIGS. 4-6, the applicator 40 is a collection of textile strands. However, unlike the embodiment in FIGS. 1-3, the applicator 40 is a 85% acrylic, 15% nylon composition also made into strands 42 prepared in rope form. Each strand 42 is approximately 3.5 mm in diameter and includes approximately 6-8 individual fibers of the 85% acrylic, 15% nylon composition in the embodiment shown. When combined, the individual fibers are woven to produce a "herringbone" appearance to the strand 42. The applicator 40 includes approximately 8-24 strands 42 in the shown embodiment.

Figure 7:
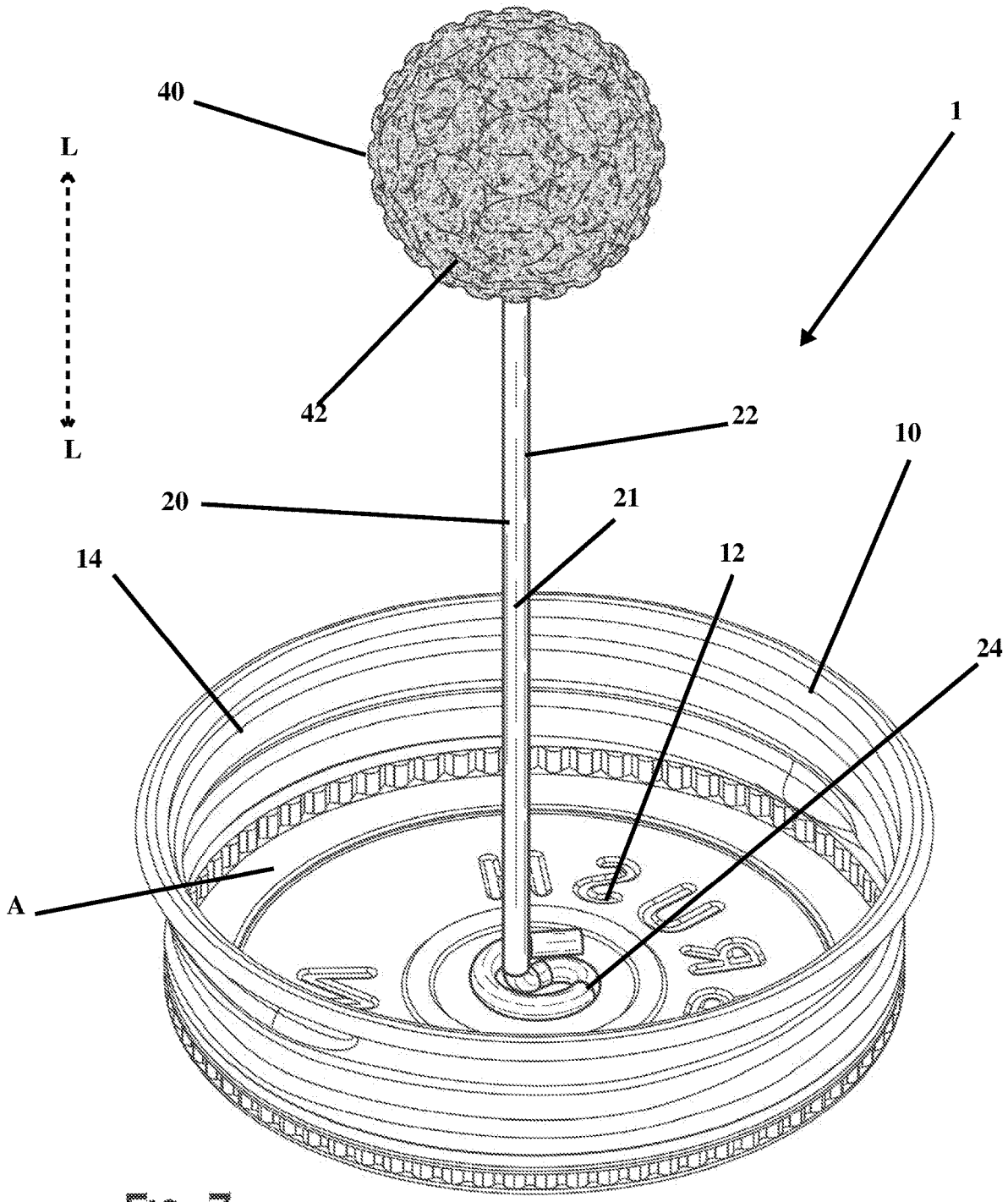
FIG. 7 is a perspective view of another closure according to the invention.
Figure 8:
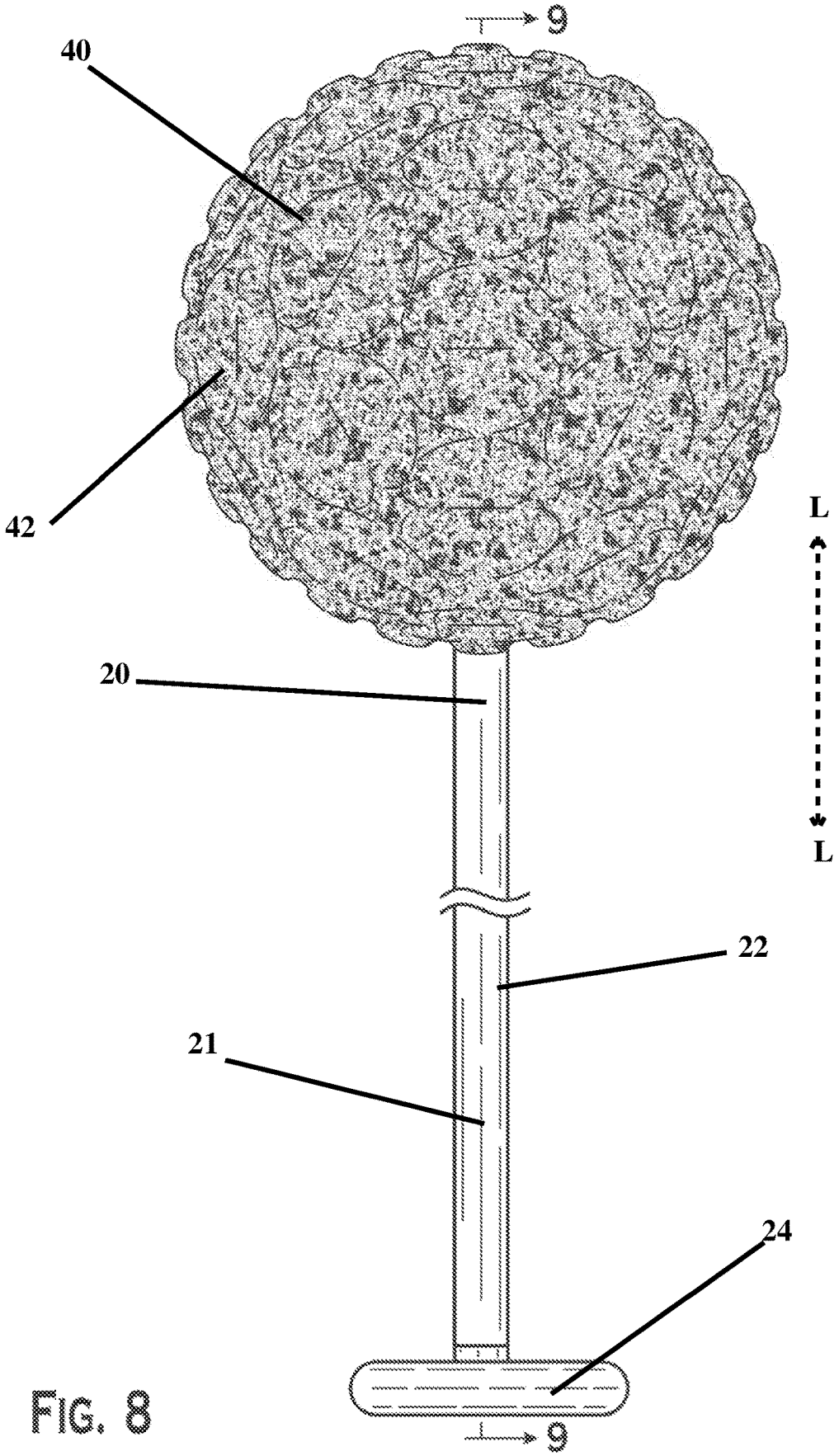
FIG. 8 is a front view of an applicator for the container closure of FIG. 7.
Figure 9:
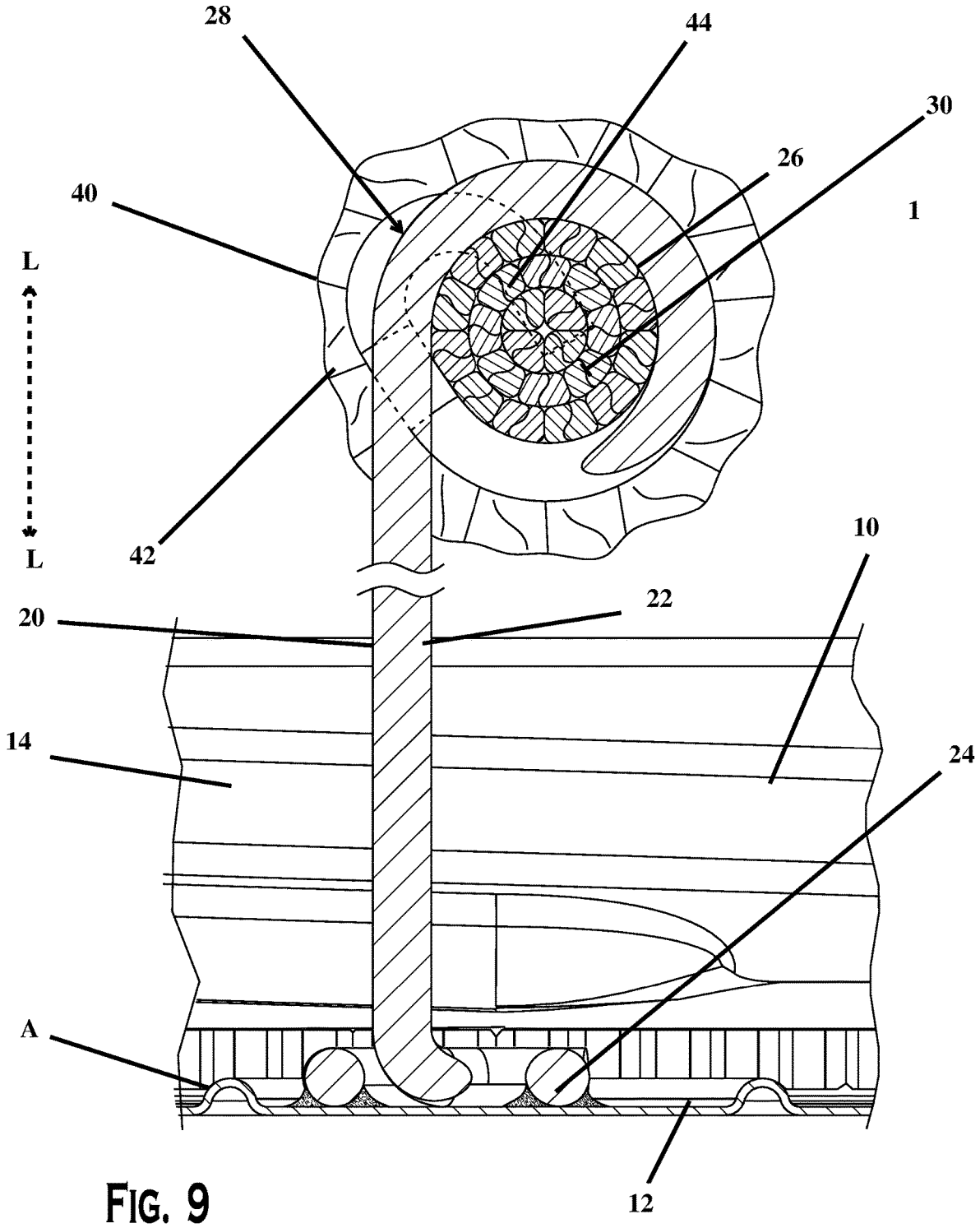
FIG. 9 is a section view of the container closure of FIG. 8, taken along line 9-9.
Figures 10, 11, 12:
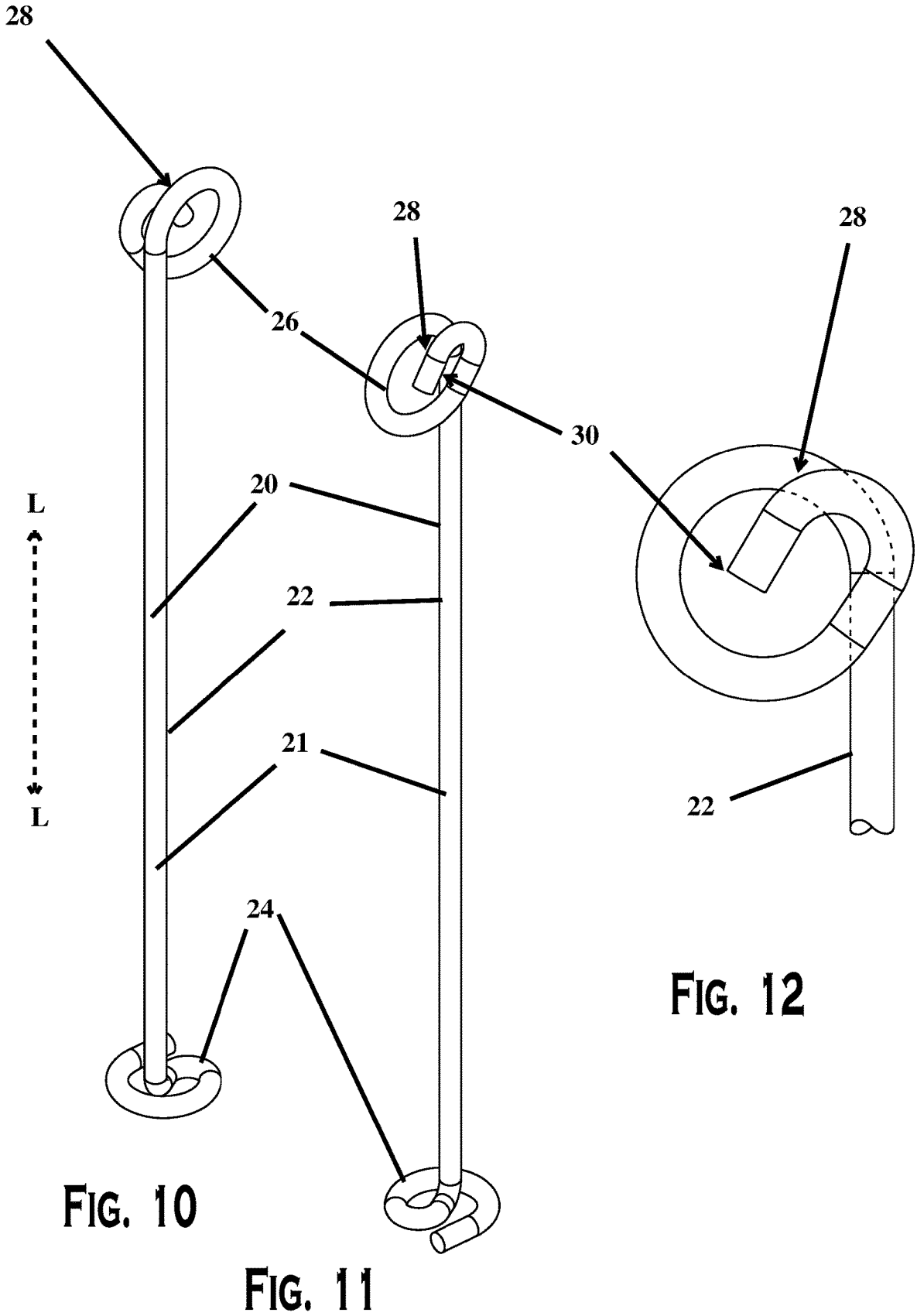
FIG. 10 is a perspective view of a stem for the container closure according to the invention.
FIG. 11 is another perspective view of the stem of FIG. 10.
FIG. 12 is a right view of a stem head of the stem of FIG. 10.
Figure 13:
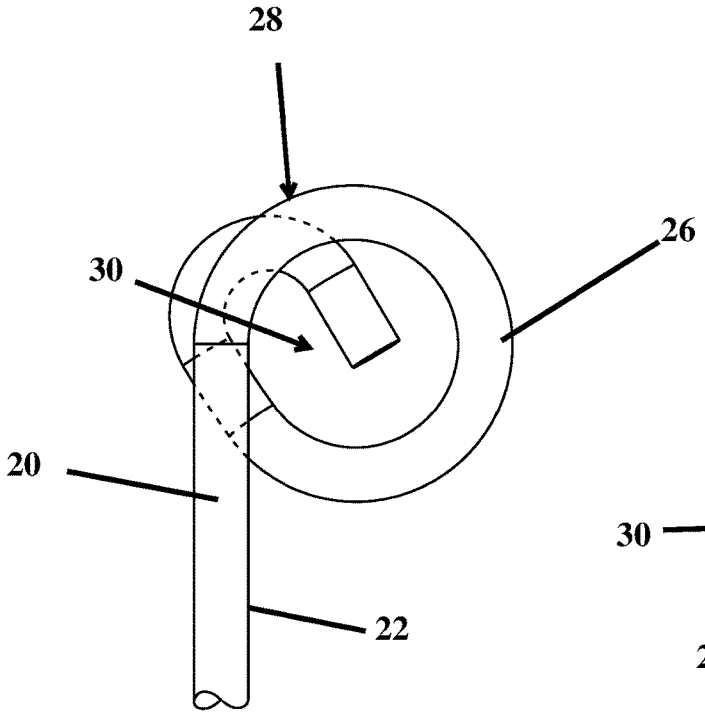
FIG. 13 is a left view of the stem head of FIG. 12.
Figure 14:
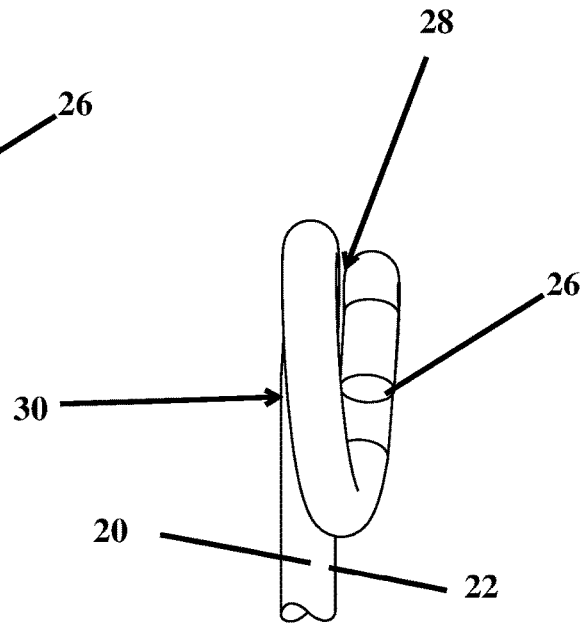
FIG. 14 is a rear view of the stem head of FIG. 12.
Figure 15:
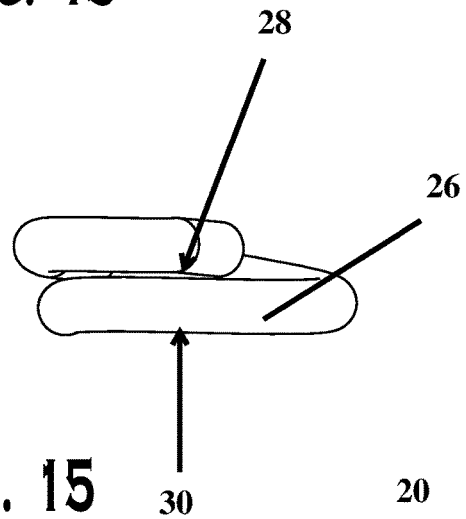
FIG. 15 is a top view of the stem head of FIG. 12.
Figure 16:
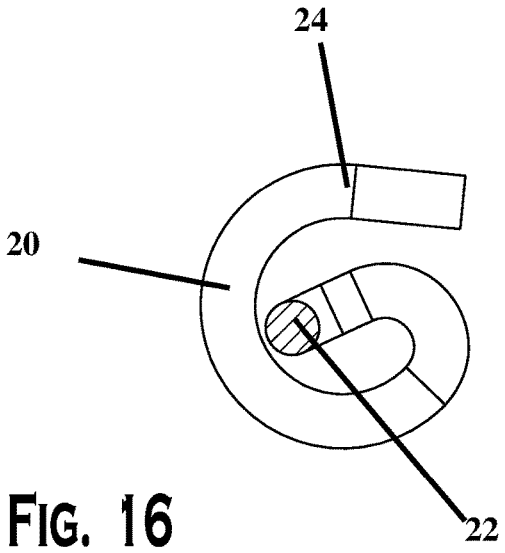
FIG. 16 is a top view of a base of the stem of FIG. 10.

In the embodiment shown in FIGS. 7-9, the applicator 40 is a collection of textile strands. However, unlike the embodiment in FIGS. 1-3, the applicator 40 is a 100% acrylic composition made into strands 42 prepared in rope form. Each strand 42 is approximately 4.0 mm in diameter and includes approximately 9-11 individual fibers of the 100% acrylic composition in the embodiment shown. When combined, two individual fibers are twisted in a loose helix arrangement to form the strand 42. The applicator 40 includes approximately 8-24 strands 42 in the shown embodiment.

Now, with reference to FIGS. 1-16, an exemplary assembly and manufacturing of the container closure 1 will be described.

In order to prepare the cap 10, an electro tin plated (ETP) coil stock is threaded through working area of shuttle feeder, stamping lubricant unit, and integrated guide rails of die set. Blanking of the cap 10 is performed. Next, this blank is then formed into a shell portion of the cap 10. If necessary, embossed characters and sections are provided. Next, the cap 10 can be threaded using known rotary type threading machine. The threaded caps 10 can then be subject to known lining operations. For instance, liners A are cut and inserted into the caps 10 during a dwell portion of a machine cycle.

Next, the stem 20 is formed. First, in the embodiment shown, a wire coil stock is unwound and advanced into a wire straightening unit. The straightening unit removes the inherent bend of the wire coming off the coil. The wire is advanced and, simultaneously, the applicator 40 material is passed through a reducing die that constricts the stranded material into a tight cylindrical bundle. As the wire is fed to the desired stroke length, it pierces through the bundle of stranded material of the applicator 40 and between the wrap pin features of the tooling. The wire is cut and a wrap tooling cycles to wind the cut wire blank around the stranded material, thus securing the wire to the applicator 40 material. Next, the body 22 of the straight wire is bent to a 90° angle and forms the base 24 required to produce the center foot or planar surface that is positioned perpendicular to the longitudinal axis L of the body 22. During the same time, the head 26 is formed produce a "knuckle" about the applicator 40. Then the base 24 is soldered to the cap 10 to form the container closure 1 according to the invention.

Now with reference to FIGS. 17-26, another embodiment of the container closure 1 is shown.

Like parts of the container closure 1 are provided with like reference numerals and like component references throughout. Furthermore, features or feature combinations from the different embodiments shown and described may also represent inventive solutions or solutions included within the invention. For the sake of brevity, only the differences from the exemplary embodiments of FIGS. 1 and 17 will be described. Generally, the shown container closure 1 includes a cap 10, a stem 120, and an applicator 140 according to the invention.

FIGS. 20-26 properly illustrated the stem 120 of the container closure 1. As shown, the stem 120 is an elongated member 121, such as a wire, having a plurality of bends to form a body 122, a base 124 positioned at one end of the body 122, and a head 126 positioned at another end of the body 122 that is opposite the base 124.

As shown, the stem 120 is made from wire of material and, more particularly, being metal. However, one skilled in the art should appreciate that other materials may be used, including plastics and composites, which may be used to provide support to and position of the applicator 140 with respect to the cap 10. The stem 120 should be made from a rigid, sturdy material and should not react with a substance in the container. To assure rapid inexpensive manufacture of the stem 120, a relatively soft metal is generally used for construction of the stem 120.

The body 122 is a section of the elongated member 121 that is substantially straight in the embodiment shown. The length of the body 122 is dependent on the height of a container the container closure 1 is sealed with. Typically, the body 122 is of a length that allows the applicator 140 to reach a bottom of the container when the cap 10 is secured to the container.

As shown, the base 124 is a section of the stem 120. More particularly, the base 124 is a section of the elongated member 121. In the embodiment shown, the base 124 includes a plurality of bends to form a planar surface that is perpendicular with respect to a longitudinal axis L of the body 122. In an exemplary embodiment of the invention, the base 124 extends from the body by a 90-degree bend. In an exemplary embodiment of the invention, the base 124 includes a plurality of bends in the elongated member 121. As shown, the base 124 is C-shaped from the 90-degree bend. However, one skilled in the art should appreciate that the base 124 could be shaped differently to provide a planar surface that is perpendicular with respect to the longitudinal axis L of the body 122.

Likewise, as shown, the head 126 is also section of the stem 120 and, more particularly, a section of the elongated member 121 shaped to secure the applicator 140. However, the head 126 includes a plurality of bends to form a planar surface that is parallel with respect to a longitudinal axis L of the body 122. In an exemplary embodiment of the invention, the head 26 extends from the body by a 90-degree bend.

The head 126 includes a stop 128, a support 130, and a retention member 132. In an exemplary embodiment of the invention, the stop 128 extends from the 90-degree bend. The stop 128 is a u-shaped member having a plurality of 90-degree bends. Then support 130 extends upward from the stop 128. The length of the support 130 is dependent on the height of the applicator 140. The retention member 132 is also a u-shaped member having a plurality of 90-degree bends. However, the retention member 132 is bent perpendicular with respect to the stop 128. Furthermore, retention member 132 includes a lateral applicator receiving gap 134 positioned between ends u-shaped member to receive the applicator 140. One skilled in the art should appreciate that the head 26 could be shaped as long as the head 26 is capable of holding the applicator 140.

Figure 17:
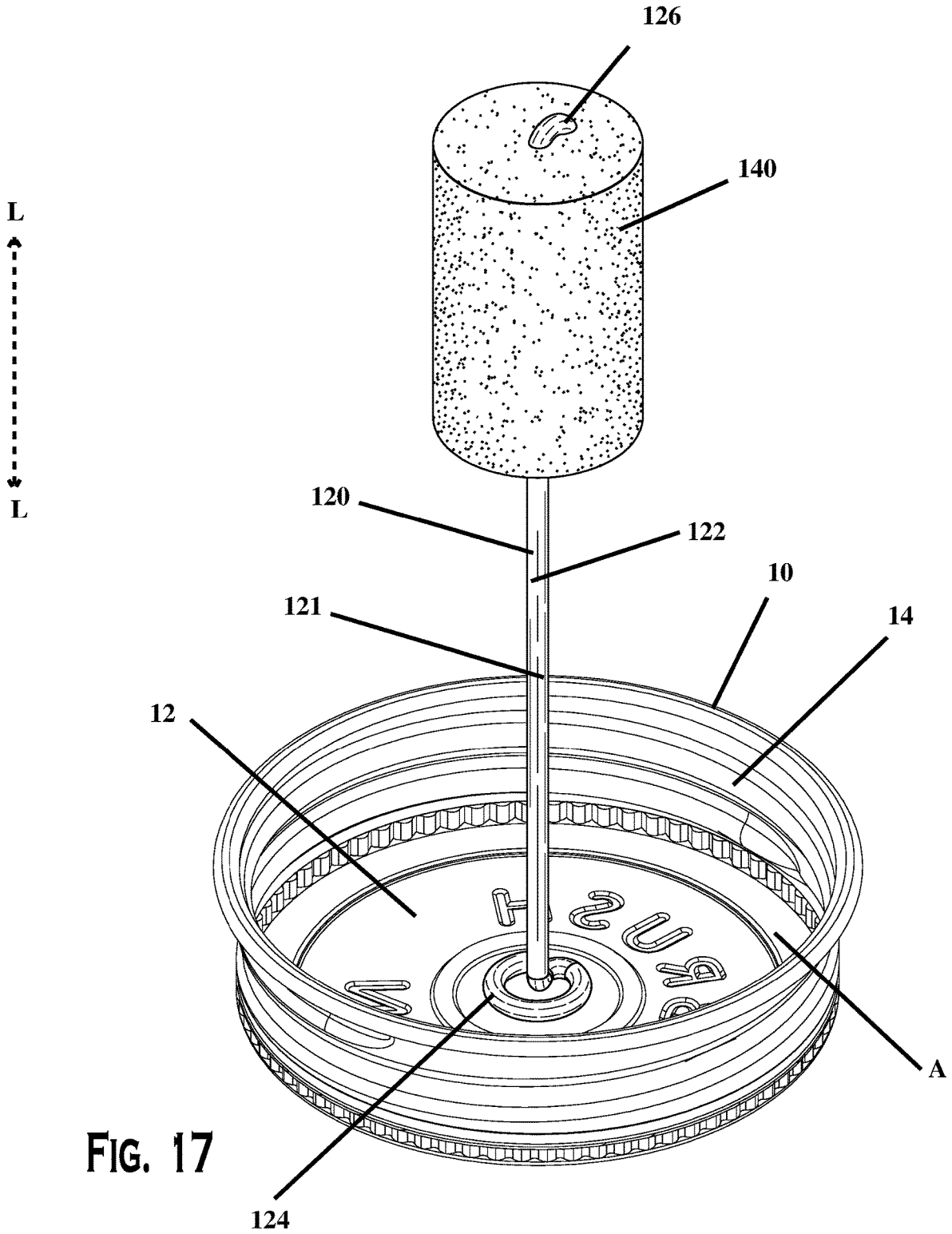
FIG. 17 is a perspective view of another container closure according to the invention.
Figure 18:
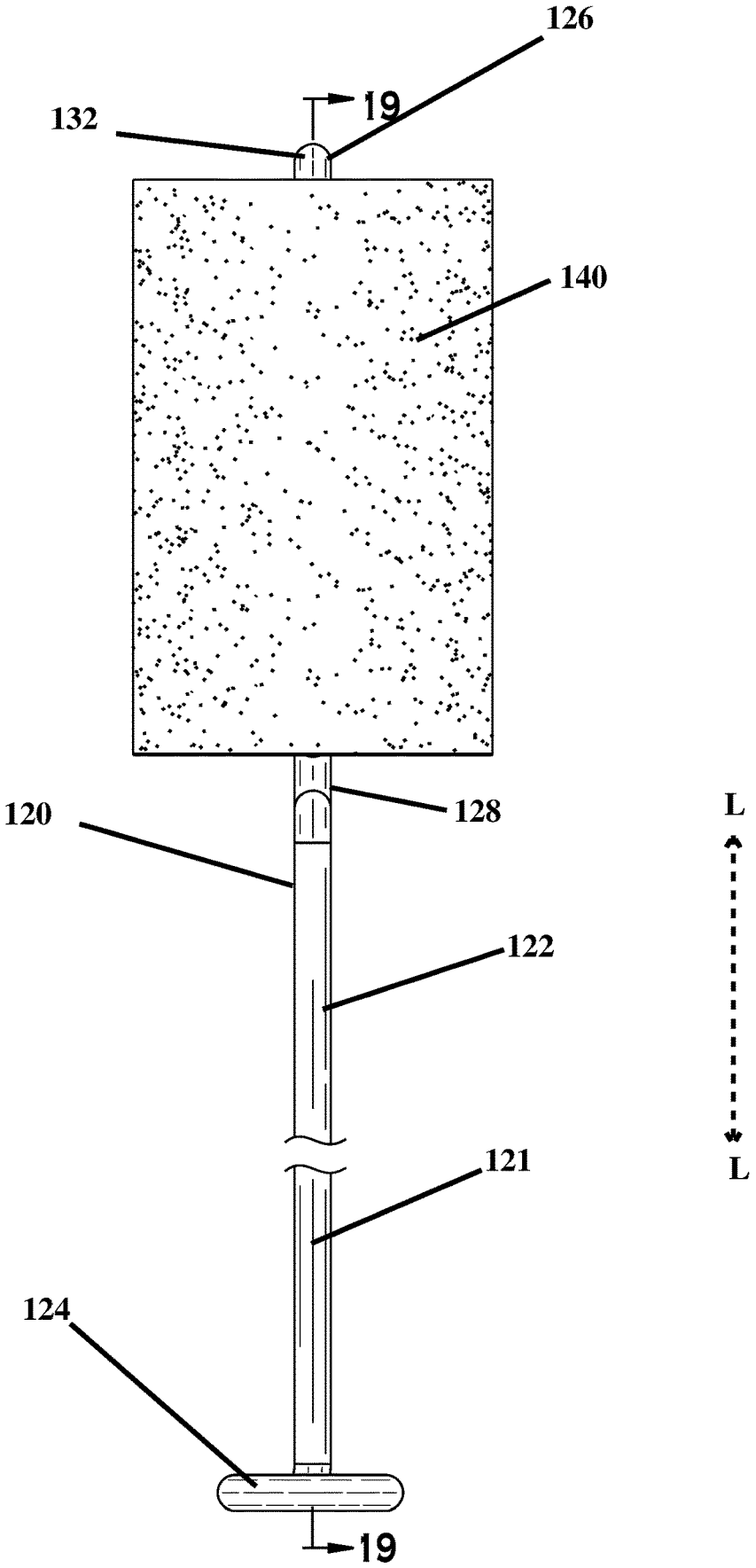
FIG. 18 is a front view of an applicator for the container closure of FIG. 17.
Figure 19:
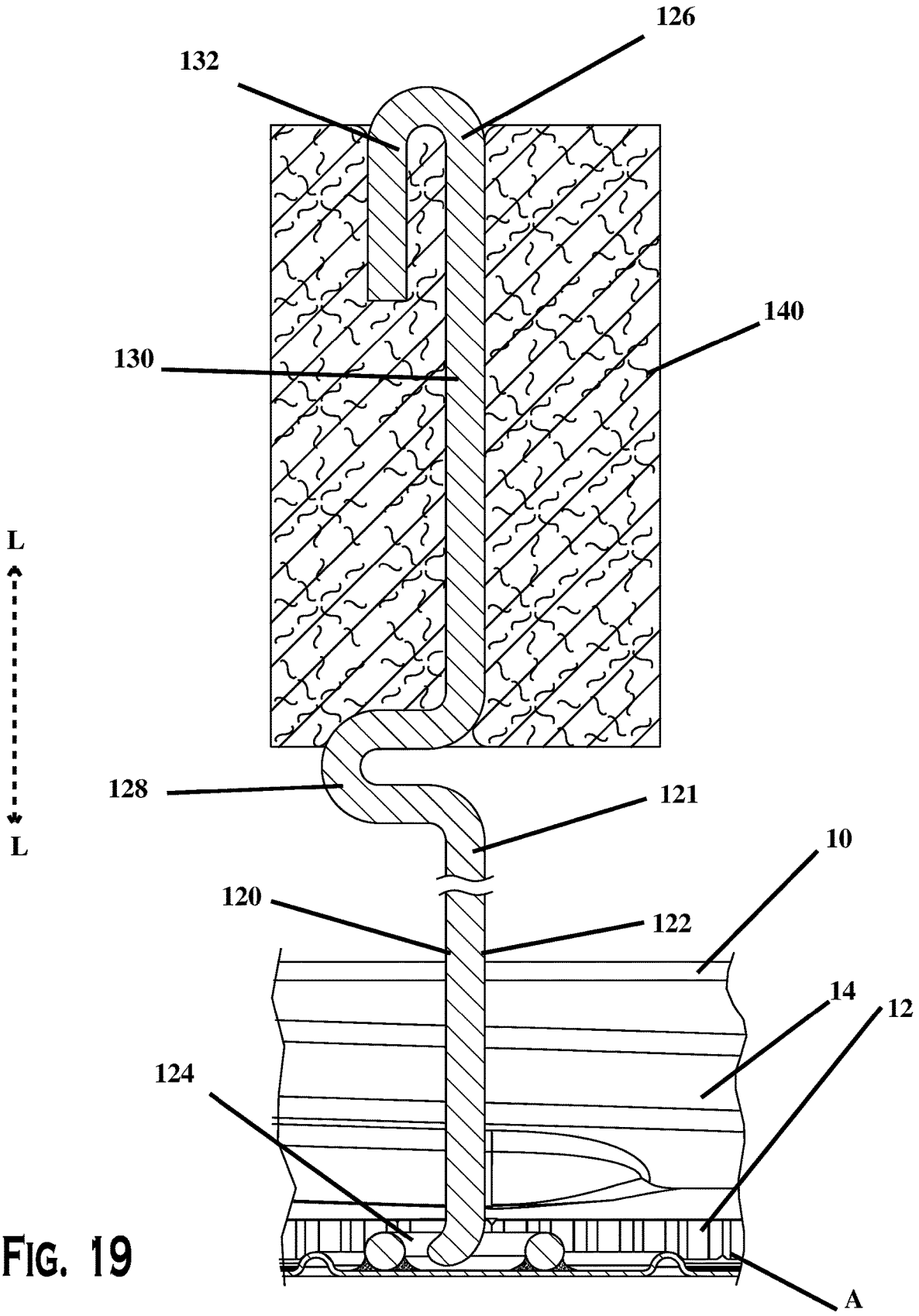
FIG. 19 is a section view of the container closure of FIG. 18, taken along line 19-19.
Figure 20:
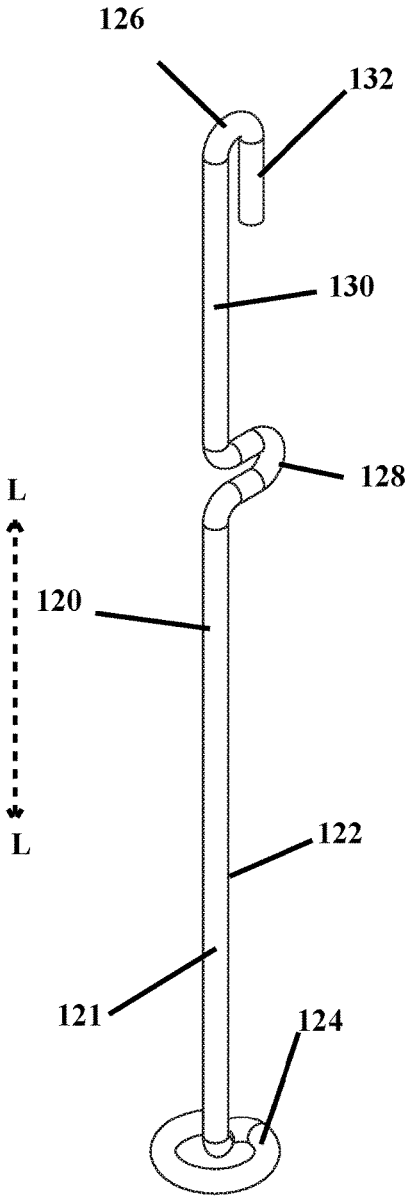
FIG. 20 is a left perspective view of a stem for the container closure of FIG. 17.
Figure 21:
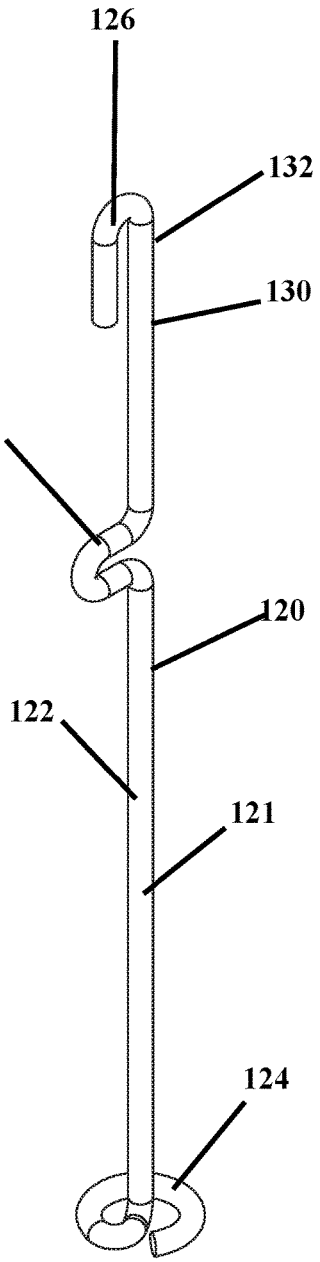
FIG. 21 is a right perspective view of a stem for the container closure of FIG. 17.
Figure 22:
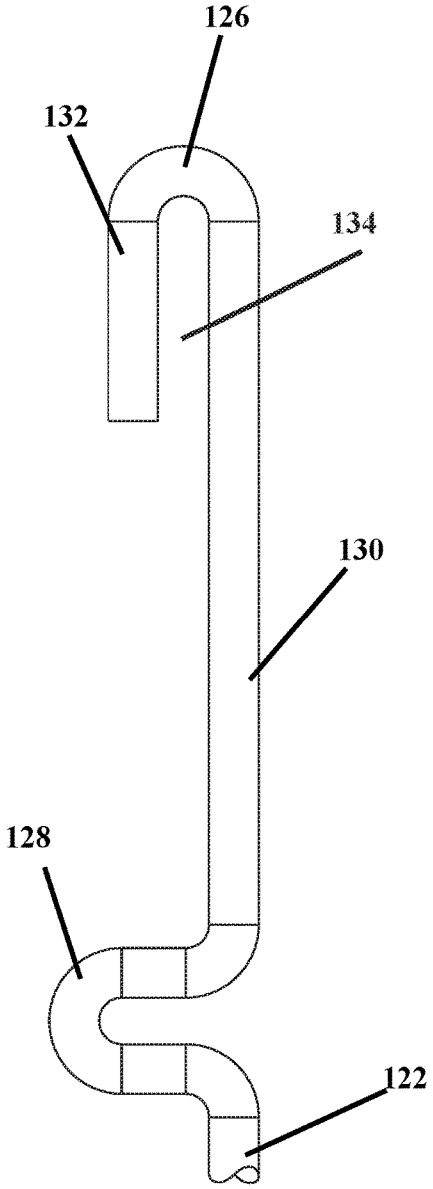
FIG. 22 is a right view of a stem head of the stem of FIG. 20.
Figure 23:
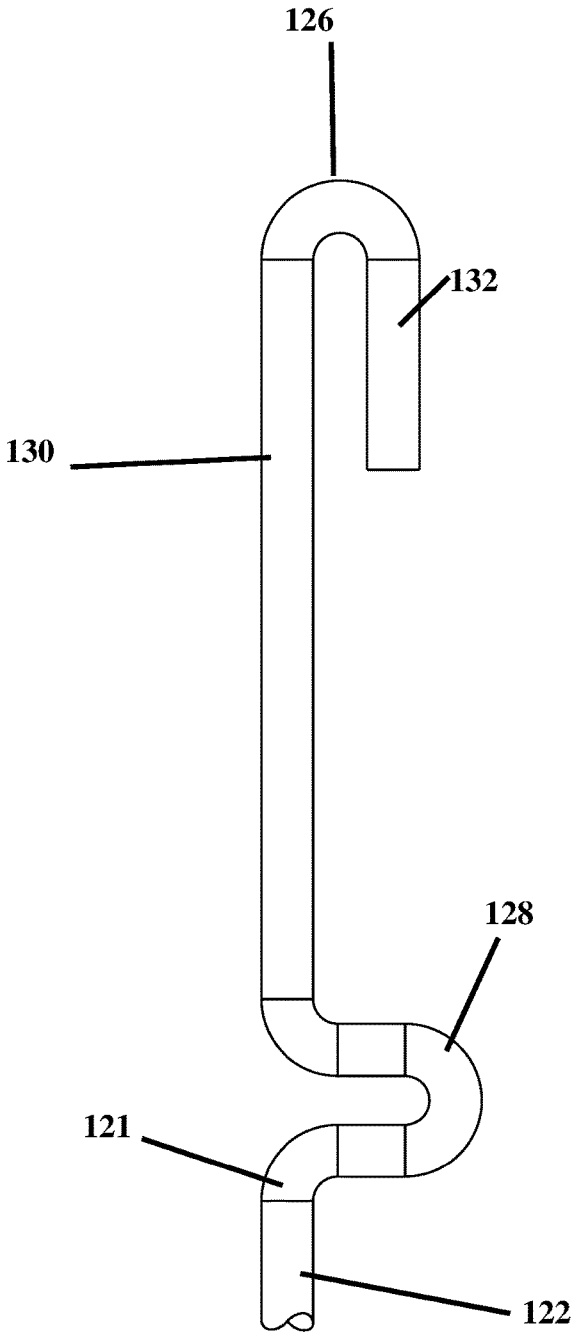
FIG. 23 is a left view of the stem head of FIG. 20.
Figure 24:
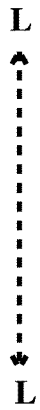
FIG. 24 is a rear view of the stem head of FIG. 20.
Figure 24:
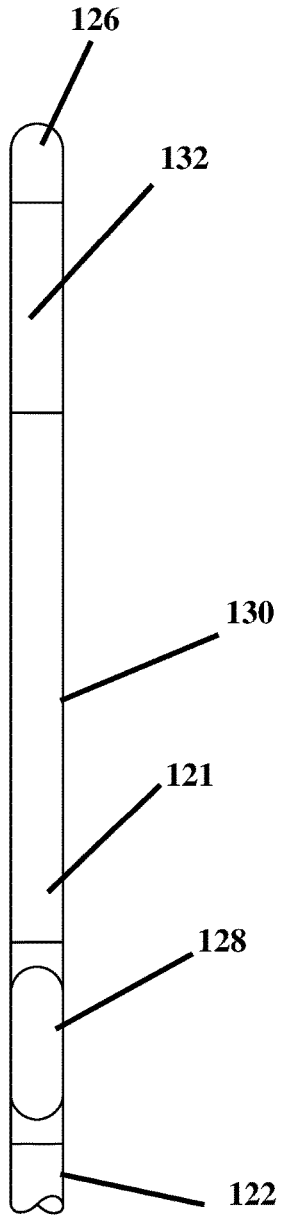
Figure 25:
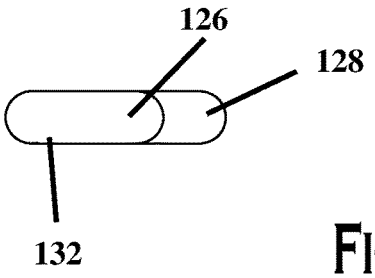
FIG. 25 is a top view of the stem head of FIG. 20.
Figure 26:
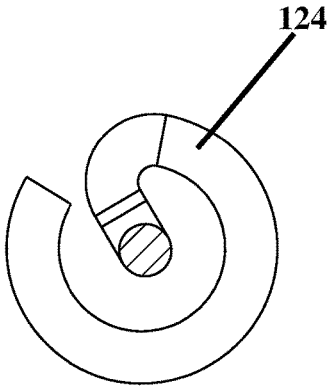
FIG. 26 is a top view of a base of the stem of FIG. 17.

In the embodiment shown in FIGS. 17-19, the applicator 140 is a felt plug. In the shown embodiment, the applicator 140 is cylindrically shaped and has the following dimensions: 0.500" to 0625" outside diameter and 1.00" to 1.50" length. In the shown embodiment, the applicator 140 has a wool content of 80-90%. More particularly, the applicator 140 has a wool content of 85%. Furthermore, in the shown embodiment, the applicator 140 has a density of 0.125 to 1.00 lbs/yd$^2$. More particularly, table 1 demonstrates the physical properties of the applicator 140.

TABLE 1

Physical Properties of the Applicator 140
Physical Properties

| | |
|---|---|
| Specific Gravity (%) | 34% |
| Thermal Conductivity (70 F.) (btu/hr/ft$^2$/degree F./in) | 0.35 |
| Thermal Expansion | 0 |
| Air Permeability ((1/16") (cfm/ft$^2$/0.5 H2) | 15-35 |
| Liquid Absorption (% by weight) | >190% |
| Liquid Absorption (% by volume) | 76% |
| Capillarity (wicking height; 575 SSU, 70 F.) in | 4 |
| Coefficient of Friction Vibration Absorption | 0.37 |

Now, with reference to FIGS. 17-26, an exemplary assembly and manufacturing of the container closure 1 will be described.

In order to prepare the cap 10, an electro tin plated (ETP) coil stock is threaded through working area of shuttle feeder, stamping lubricant unit, and integrated guide rails of die set. Blanking of the cap 10 is performed. Next, this blank is then formed into a shell portion of the cap 10. If necessary, embossed characters and sections are provided. Next, the cap 10 can be threaded using known rotary type threading machine. The threaded caps 10 can then be subject to known lining operations. For instance, liners A are cut and inserted into the caps 10 during a dwell portion of a machine cycle.

Next, the stem 120 is formed. First, in the embodiment shown, a wire coil stock is unwound and advanced into a wire-straightening unit. The straightening unit removes the inherent bend of the wire coming off the coil. The wire is advanced and formed with the body 122, the stop 128, and the support 130. As the wire is fed through the applicator 140 material and is positioned along the support 130 and the stop 128. The applicator 140 is then secured when the retention member 132 is wrapped around and enters a top section of the applicator 140. Next, the body 122 of the straight wire is bent to a 90° angle and forms the base 124 required to produce the center foot or planar surface that is positioned perpendicular to the longitudinal axis L of the body 122. Then the base 124 is soldered to the cap 10 to form the container closure 1 according to the invention.

The foregoing illustrates some of the possibilities for practicing the invention. Many other embodiments are possible within the scope and spirit of the invention. Therefore, more or less of the aforementioned components can be used to conform to that particular purpose. It is, therefore, intended that the foregoing description be regarded as illustrative rather than limiting, and that the scope of the invention is given by the appended claims together with their full range of equivalents.

What is claimed is:

1. A container closure, comprising:

a cap formed to secure to a container;

a stem having a plurality of bends that form a body, a base positioned at one end of the body and secured to an inner surface of the cap, and a head positioned at another end of the body that is opposite the base, the head includes:

a plurality of bends to form a planar surface that is parallel with respect to a longitudinal axis (L) of the body and is a G-shaped member extending 90-degree from the body; and a lateral applicator receiving gap positioned between ends of the G-shaped member and a horizontal applicator receiving space extending there through a substantial middle thereof;

an applicator having a plurality of strands prepared into rope form by single fibers and a core secured by the head, wherein the applicator includes 8-24 strands.

2. The container closure according to claim 1, wherein the plurality of strands are 100% polyester.

3. The container closure according to claim 2, wherein each strand of the plurality of strands is approximately 6 mm in diameter.

4. The container closure according to claim 3, wherein the applicator has a frayed appearance along an outer surface thereof.

5. The container closure according to claim 1, wherein the cap includes a circular top wall and a depending annular side wall.

6. The container closure according to claim 2, further comprising a liner positioned along the circular top wall.

7. The container closure according to claim 2, wherein the stem is a metal wire.

8. The container closure according to claim 2, wherein the body includes an elongated member and is substantially straight.

9. The container closure according to claim 8, wherein the base includes a plurality of bends to form a planar surface that is perpendicular with respect to a longitudinal axis (L) of the body.

10. The container closure according to claim 9, wherein the base extends from the body by a 90-degree bend.

11. The container closure according to claim 10, wherein the base is G-shaped.

12. The container closure according to claim 1, wherein each strand of the plurality of strands includes 6-8 individual fibers of a 85% acrylic, 15% nylon composition.

13. The container closure according to claim 12, wherein each strand of the plurality of strands is approximately 3.5 mm in diameter.

14. The container closure according to claim 1, wherein each strand of the plurality of strands includes 9-11 individual fibers of a 100% acrylic composition.

15. The container closure according to claim 14, wherein each strand of the plurality of strands is approximately 4.0 mm in diameter.

* * * * *